US007036253B2

(12) United States Patent
Minaebo

(10) Patent No.: US 7,036,253 B2
(45) Date of Patent: May 2, 2006

(54) HANGING BASKET LABEL COLLAR

(75) Inventor: Gregg Edward Minaebo, Muskegon, MI (US)

(73) Assignee: International Master Products Corporation, Montague, MI (US)

( * ) Notice: Subject to any disclaimer, the term of this patent is extended or adjusted under 35 U.S.C. 154(b) by 0 days.

(21) Appl. No.: 10/424,686

(22) Filed: Apr. 28, 2003

(65) Prior Publication Data

US 2004/0211119 A1 Oct. 28, 2004

(51) Int. Cl.
*G09F 23/00* (2006.01)
*G09F 1/00* (2006.01)

(52) U.S. Cl. ..... 40/124.09; 40/645; 47/29.5; 47/67

(58) Field of Classification Search ..... 40/310, 40/308, 645, 322, 124.09, 124.14, 124.15; 116/63 T; 47/41.11, 41.01, 67, 29.7, 29.5
See application file for complete search history.

(56) References Cited

U.S. PATENT DOCUMENTS

| | | | | | |
|---|---|---|---|---|---|
| 1,063,826 | A | * | 6/1913 | Moyer | 294/33 |
| 1,793,348 | A | * | 2/1931 | Wood | 40/310 |
| 1,829,915 | A | * | 11/1931 | Wasser | 40/310 |
| 2,051,596 | A | * | 8/1936 | Harbaugh | 47/29.5 |
| 2,965,376 | A | * | 12/1960 | Kessler | 273/338 |
| 4,462,145 | A | * | 7/1984 | Schulze | 29/428 |

* cited by examiner

*Primary Examiner*—Cassandra Davis
(74) *Attorney, Agent, or Firm*—Varnum, Riddering, Schmidt & Howlett LLP

(57) ABSTRACT

A three sided label structure (100) is disclosed, having three interconnected label sections (101, 102, 103). The label sections (101, 102, 103) are provided with relevant information about a plant supported in a container (120). Hinge sections (105, 106) are provided to facilitate a bending of labels so as to form triangular label structures.

4 Claims, 3 Drawing Sheets

HANGING BASKET LABEL COLLAR

BACKGROUND OF THE INVENTION

1. Field of the Invention

The invention relates to hanging baskets and more particularly to a display collar for a hanging basket 2. Background Art Decorative plants are commonly sold in hanging baskets suspended by wires, chains or similar hanging devices. Typically, the hanging devices are gathered or joined at a point above the basket and joined to a hook or similar device to support the basket. To provide purchase and care information to the consumer, baskets are often provided with labels displaying a name or characteristics of the plant, as well as care and feeding instructions. Prior art labels are typically in the form of a small rectangular shape or a long thin strip. Such labels are commonly displayed either by inserting the baskets hook through a hole in the label, by passing hanger wires through a hole in the label or wrapping the label around the wire. The label may also be attached directly to the basket.

Visibility of the labels is of paramount importance, since the information on the labels is of critical importance in making a purchasing decision. However, an inherent problem with prior art labels commonly used is that there is limited visibility of the label. At retail, flower baskets are frequently hung from racks above eye level of customers and labels attached to the baskets hook are often difficult to find read. Furthermore, labels attached to the basket hanging wire or directly to the basket are often obscured by foliage, by the time the basket is ready for marketing.

SUMMARY OF THE INVENTION

These and other problems of the prior art are over come in accordance with the present invention by an improved flower basket labeling arrangement comprised of a collar intended to be supported on support wires, or the like, of the hanging basket. Hanging basket typically have three support wires, each having one end attached to the upper rim of the basket, extending at an angle from the rim to a common position above a central area of the basket, where the wires are joined. A collar in accordance with the present invention is preferably dimensioned such that the collar supported on basket support wires at a position above any foliage in the basket.

The collar is provided with an upper opening and a lower opening. The lower opening is larger than the upper opening to maintain the collar at a desired position on angled support wires supporting the basket. Advantageously, information displayed on the collar supported above plant foliage can be read without being unimpeded by the foliage.

In one specific embodiment of the invention, the collar comprises three substantially equally dimensioned sections and is adapted to be supported on three hanging wires of a flower basket. A middle section of the collar is hingedly connected to two end sections, disposed adjacent to the middle section. Preferably, one of the two end sections is provided with a slotted opening and the other of the end sections is provided with a tab dimensioned to engage the slotted opening.

DETAILED DESCRIPTION

Figure 1:
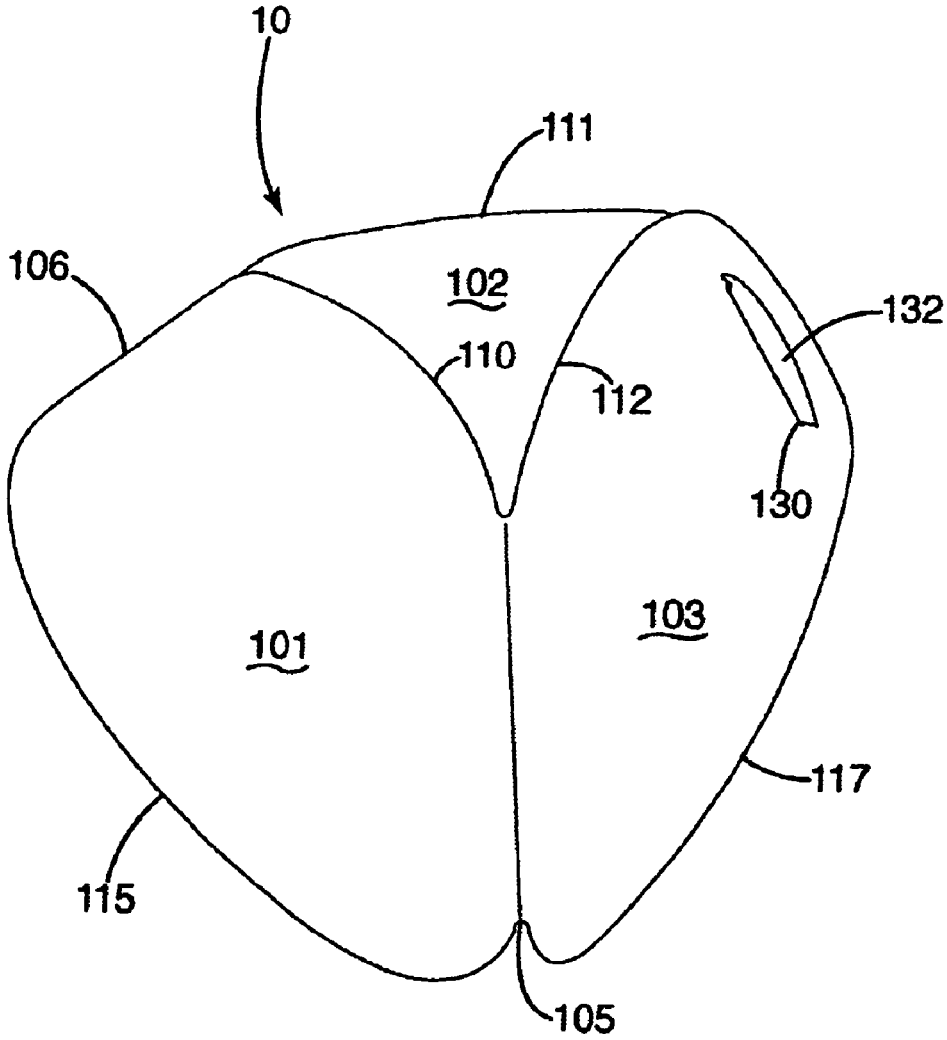
FIG. 1 is a perspective view of a three-sided label structure incorporating principles of the invention.
Figure 2:
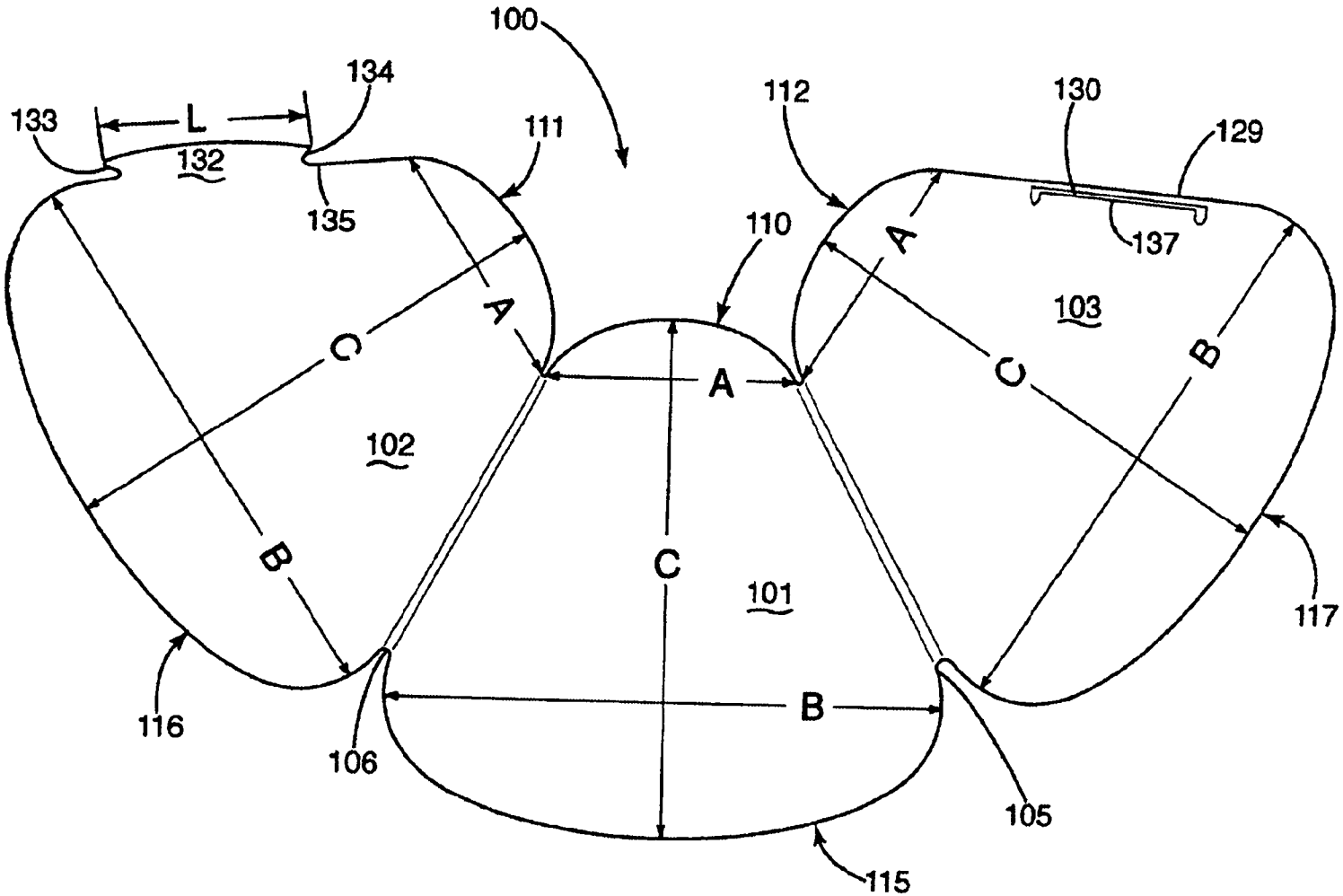
FIG. 2 is an exploded view of the label structure of FIG. 1.
Figure 3:
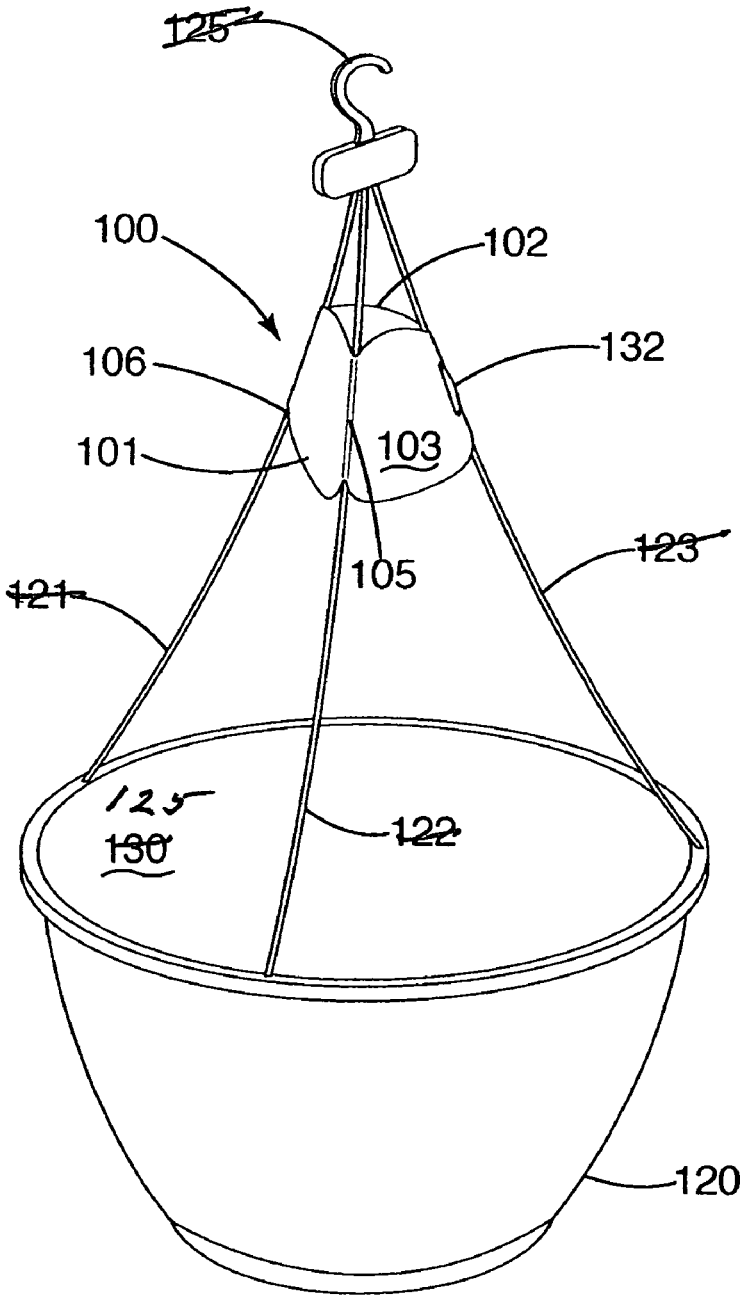
FIG. 3 is a perspective view of the label structure of FIGS. 1 and 2 supported on the hanging wires of a hanging basket.

An illustrative embodiment of the invention is shown in FIGS. 1 through 3. FIG. 1 is a perspective view of three sided label structure 100 formed from three interconnected label sections, sections 101, 102 and 103. The label structure may be formed of any suitable material common used for labeling plants and the like. The three sided label structure 100 is adapted to be supported on flower basket support wires in a manner generally depicted in FIG. 3. The three separate label sections may each be provided with relevant information about a plant supported in the container 120 of FIG. 3. By way of example, one of the three label sections, e.g. section 101, may recite specific characteristic and pricing information about a plant displayed in the basket, while another label section, e.g. section 102, may display a trademark or trade name and pictorial representation of the plant in full bloom. Further information of interest to a perspective buyer, or such other information as a dealer may wish to display, may be displayed on the third label section, e.g. section 103.

FIG. 2 is a plan view of the label structure 100 prior to being folded in the configuration shown in FIG. 1. As clearly shown in FIG. 2, each of the three sections 101,102 and 103 has a basic triangular form. Upper edges 110, 111 and 112 and lower edges 115, 116 and 117, of the sections 101, 102 and 103, respectively, are preferably rounded for the sake of esthetics. Section 101 and section 103 are joined along a hinge section 105 and sections 101 and 102 are joined along a hinge section 106. The hinge sections are provided to facilitate a bending of the label to form the triangularly shaped label structure depicted in FIG. 1 and FIG. 3. The three label sections 101, 102 and 103 each have an upper cross dimension A, a lower cross dimension B and a longitudinal dimension C. Preferably, the dimensions A, B and C are the same for all three label sections.

The section 102 is provided with a tab 132 for engagement with a slotted opening 130 in section 103. The tab 132 is provided with undercut 133 and 134 and the opening 130 is to facilitate insertion of the tap 132 in the slot 130. The overall length Li of the tab 132 is preferably somewhat greater than the overall length L2 of the slot 130, to maintain the tab 132 in the slot 130.

What is claimed is:

1. In combination, a label collar coupled to a hanging basket having a circumferentially extending upper rim and at least three support wires extending upwardly from spaced apart positions adjacent the upper rim, the label collar having first, second and third interconnected label sections (101, 102, 103), each label section having a substantially flat display surface and opposing side edges, the label structure comprising a first hinge section (106) interconnecting the first label section (101) and the second label section (102) and second hinge section (105) interconnecting the first label section (101) and the third label section (103);

one of the second and third label sections (102, 103) having a slotted opening (130) and another of the second and third label sections (102, 103) being provided with a tab (132) for engagement with the slotted opening (130), to form a three sided label collar supportable on the at least three support wires at a selected position above the rim.

2. The label collar in accordance with claim 1 wherein each of the label sections (101, 102, 103) has an upper edge (110, 111, 112) and a lower edge (115, 116, 117) and a first cross dimension (A) at a predefined distance from the upper edge and wherein the cross dimension (A) is the same for each of the label sections (101, 102, 103).

3. The label collar in accordance with claim 2 and further comprising a lower edge and second cross dimension (B) at a predefined distance from the lower edge and wherein the second cross dimension (B) is the same for each of the label sections (101, 102, 103).

4. A label collar for use with hanging baskets having a circumferentially extending upper rim and at least three support wires extending upwardly from spaced apart positions adjacent the upper rim, the label collar having first, second and third interconnected label sections, each label section having a substantially flat display surface and opposing side edges, the label structure comprising a first hinge section interconnecting the first label section and the second label section, and the second hinge section interconnecting the first label section and the third label section;

one of the second and third label sections having a slotted opening and another of the second and third label sections being provided with a tab for engagement with the slotted opening, to form a three sided label collar supportable on the at least three support wires, at a selected position above the rim; and the upper rim is of a predefined diameter and the label sections are dimensioned relative to the predefined diameter such that the label sections are supported on the support wires at a predetermined distance above the rim.

* * * * *

UNITED STATES PATENT AND TRADEMARK OFFICE

CERTIFICATE OF CORRECTION

PATENT NO. : 7,036,253 B2
APPLICATION NO. : 10/424686
DATED : May 2, 2006
INVENTOR(S) : Gregg Edward Minnebo It is certified that error appears in the above-identified patent and that said Letters Patent is hereby corrected as shown below:

The spelling of the Inventor's name on Title page item 75 should be changed from "Minaebo" to -- Minnebo -- .

Signed and Sealed this

Twenty-third Day of January, 2007

JON W. DUDAS
*Director of the United States Patent and Trademark Office*